US007926921B2

(12) United States Patent
Morita

(10) Patent No.: US 7,926,921 B2
(45) Date of Patent: Apr. 19, 2011

(54) LIQUID TRANSPORTING APPARATUS

(75) Inventor: Yoshitsugu Morita, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 203 days.

(21) Appl. No.: 12/412,294

(22) Filed: Mar. 26, 2009

(65) Prior Publication Data

US 2009/0244211 A1 Oct. 1, 2009

(30) Foreign Application Priority Data

Mar. 28, 2008 (JP) ..... 2008-085355

(51) Int. Cl.
*B41J 2/45* (2006.01)

(52) U.S. Cl. ..... 347/71

(58) Field of Classification Search ..... 347/71, 347/68–69, 70, 72, 19; 400/124.14, 124.16; 310/311, 324, 327, 365
See application file for complete search history.

(56) References Cited

U.S. PATENT DOCUMENTS

| | | | | |
|---|---|---|---|---|
| 6,648,455 | B2 | 11/2003 | Takagi | |
| 2005/0190232 | A1 | 9/2005 | Lee et al. | |
| 2007/0200463 | A1 | 8/2007 | Watanabe et al. | |
| 2008/0030554 | A1 | 2/2008 | Sugahara | |
| 2009/0058899 | A1 * | 3/2009 | Umeda | 347/19 |
| 2009/0102880 | A1 * | 4/2009 | Kimura | 347/19 |

FOREIGN PATENT DOCUMENTS

| | | | |
|---|---|---|---|
| JP | H04-235050 | A | 8/1992 |
| JP | H08-001950 | A | 1/1996 |
| JP | H11-129467 | A | 5/1999 |
| JP | 2002-059547 | A | 2/2002 |
| JP | 2003-127367 | A | 5/2003 |
| JP | 2003-291340 | A | 10/2003 |
| JP | 2005-178202 | A | 7/2005 |
| JP | 2005-238846 | A | 9/2005 |
| JP | 2006-341508 | A | 12/2006 |
| JP | 2007-021854 | A | 2/2007 |
| JP | 2007-144911 | A | 6/2007 |
| JP | 2007-266566 | A | 10/2007 |
| JP | 2008-055899 | A | 3/2008 |

OTHER PUBLICATIONS

Japan Patent Office; Notice of Reasons for Rejection in Japanese Patent Application No. 2008-085355 (counterpart to the above-captioned U.S. patent application) mailed Apr. 27, 2010.

* cited by examiner

*Primary Examiner* — K. Feggins
(74) *Attorney, Agent, or Firm* — Baker Botts LLP

(57) ABSTRACT

A liquid transporting apparatus which transports a liquid includes a channel unit having a surface which is electroconductive and a liquid channel which includes a pressure chamber; a piezoelectric actuator applying a pressure to the liquid in the pressure chamber and having a piezoelectric layer arranged to face the surface of the channel unit and to cover the pressure chamber, electrodes which are arranged in the piezoelectric layer to face the pressure chamber, and a first isolating film arranged between the piezoelectric layer and the surface of the channel unit to cover the pressure chamber; and a deterioration detecting mechanism detecting a deterioration of the first isolating film and having a second isolating film which is electroconductive and stacked on a surface, of the first isolating film, on a side of the piezoelectric layer, and which is insulated from both the electrodes and the channel unit.

12 Claims, 9 Drawing Sheets

LIQUID TRANSPORTING APPARATUS

CROSS REFERENCE TO RELATED APPLICATION

The present application claims priority from Japanese Patent Application No. 2008-085355, filed on Mar. 28, 2008, the disclosure of which is incorporated herein by reference in its entirety.

BACKGROUND OF THE INVENTION

1. Field of the Invention

The present invention relates to a liquid transporting apparatus which transports a liquid.

2. Description of the Related Art

Liquid transporting apparatuses in various fields, which include a piezoelectric actuator which applies a pressure to a liquid have hitherto been known. For example, in U.S. Pat. No. 6,648,455 (corresponds to Japanese Patent Application Laid-open No. 2002-59547), an ink-jet head which includes a piezoelectric actuator which applies a pressure for jetting the ink from nozzles has been disclosed.

This ink-jet head includes a channel unit (called as a cavity plate) in which ink channels such as a plurality nozzles and a plurality of pressure chambers which communicate with the nozzles are formed, and a piezoelectric actuator which is joined to the channel unit to cover the plurality of pressure chambers. Moreover, the piezoelectric actuator has a plurality of piezoelectric layers (piezoelectric sheets) which are stacked, and individual electrodes and common electrodes which are arranged in areas facing the pressure chamber, sandwiching each of the piezoelectric layers in thickness direction-thereof. Moreover, when a voltage is applied between the individual electrodes and the common electrodes and an electric field in the thickness direction is generated in the piezoelectric layer sandwiched between the individual electrodes and the common electrodes, the piezoelectric actuator changes a volume of the pressure chamber by using a deformation (piezoelectric distortion) occurred in the piezoelectric layer, and applies a pressure to the ink in the pressure chamber.

Furthermore, the piezoelectric actuator disclosed in U.S. Pat. No. 6,648,455 is joined to the channel unit by an adhesive sheet (an adhesive layer). Here, the adhesive sheet is made of a synthetic resin material, and is provided on an entire joining surface of the piezoelectric actuator including the area facing the pressure chamber. Moreover, when the piezoelectric actuator is joined to the channel unit by the adhesive sheet, the adhesive layer in the area facing the pressure chamber functions as an ink isolating film, which prevents the ink in the pressure chamber from permeating into the piezoelectric layer.

In the piezoelectric actuator for an ink-jet head disclosed in U.S. Pat. No. 6,648,455, the piezoelectric layer and the ink in the pressure chamber are isolated by the adhesive sheet formed of a synthetic resin material. However, generally, a synthetic resin material has low ink permeation inhibiting property (ink barrier property) Moreover, a synthetic resin material is degraded with a period of use becoming long, and there may be a damage such as a crack and a scratch. Furthermore, when the ink in the pressure chamber permeates into the piezoelectric layer through the damage on the adhesive sheet formed of a synthetic resin material, there is a possibility of a short (short-circuit) occurring between the adjacent individual electrodes or between the individual electrodes and the common electrodes which are provided on the piezoelectric layer.

SUMMARY OF THE INVENTION

An object of the present invention is to provide a liquid transporting apparatus which is capable of detecting a deterioration of an isolating film which isolates a piezoelectric layer and liquid in a pressure chamber.

According to a first aspect of the present invention, there is provided a liquid transporting apparatus which transports a liquid, including: a channel unit having a surface which is electroconductive and a liquid channel which includes a pressure chamber and through which the liquid flows, the pressure chamber being open to the surface; a piezoelectric actuator applying a pressure to the liquid in the pressure chamber and having a piezoelectric layer arranged to face the surface of the channel unit and to cover the pressure chamber, electrodes which are arranged in the piezoelectric layer to face the pressure chamber, and a first isolating film formed of a resin material and arranged between the piezoelectric layer and the surface of the channel unit to face the pressure chamber; and a deterioration detecting mechanism detecting a deterioration of the first isolating film and having a second isolating film which is electroconductive and stacked on a surface, of the first isolating film, on a side of the piezoelectric layer, and which is insulated from both the electrodes and the channel unit.

According to the first aspect of the present invention, since the first isolating film made of a resin material is sandwiched between the one surface of the channel unit which is electroconductive, and the second isolating film which is electroconductive, by measuring an electrical resistance between the one surface of the channel unit and the second isolating film, it is possible to detect whether or not there is a damage of the first isolating film. Therefore, it is possible to detect the deterioration of the first isolating film and to prevent the liquid in the pressure chamber from permeating into the piezoelectric actuator. Moreover, when an electric field is applied by the electrodes at the time of driving the piezoelectric actuator, by the second isolating film which is electroconductive, it is possible to prevent the electric field from being leaked to the liquid in the pressure chamber from the piezoelectric layer. Furthermore, conversely, since it is possible to cut off a static electricity entering the piezoelectric layer from the channel unit side, it is possible to prevent a damage of the piezoelectric layer by a local electric field caused by this static electricity.

In the liquid transporting apparatus according to the present invention, the second isolating film may be formed of a material through which the liquid does not pass as easily as through the first isolating film. Since the second isolating film is positioned more toward the piezoelectric layer than the first isolating film, even when the liquid has passed through the first isolating film which allows the liquid to pass through easily (having a low barrier property), it is possible to prevent the permeation of the liquid into the piezoelectric layer by the second isolating film which does not allow the liquid to pass through easily (having a high barrier property). Moreover, since the second isolating film is covered by the first isolating film made of a resin which is soft, decline in the barrier property of the second isolating film by an occurrence of a scratch or a crack in the second isolating film is prevented.

In the liquid transporting apparatus of the present invention, the surface of the channel unit and the second isolating film may be arranged to sandwich the first isolating film therebetween; and the deterioration detecting mechanism may include a resistance detector which detects an electrical resistance between the surface of the channel unit and the second isolating film. In this case, it is possible to detect a damage in the first isolating film at any arbitrary timing including during the use of an apparatus and during a stand-by state, by measuring the electrical resistance between the electroconductive surface of the channel unit and the second isolating film by the resistance detector.

The liquid transporting apparatus according to the present invention may further include: an electric power supplying mechanism which supplies an electric power to the second isolating film, and a heating control mechanism to supply the electric power to the second isolating film such that the liquid in the pressure chamber is heated by heat released from the second isolating film. In this case, the heating control mechanism is capable of heating the liquid in the pressure chamber by controlling the supply of electric power to the second isolating film by the electrification mechanism. Consequently, even in a case in which, an environmental temperature around the apparatus is low and in a case of handling a liquid having a high viscosity, it is possible to transport the liquid with a low energy by lowering the viscosity of the liquid by raising the temperature of the liquid. Furthermore, at the time of heating the liquid, the temperature of the piezoelectric layer also rises. However, generally, since a deformation efficiency of the piezoelectric layer improves when there is a rise in the temperature, it is possible to increase an amount of displacement of the piezoelectric layer.

The liquid transporting apparatus according to the present invention may further include a temperature detector which detects a temperature around the pressure chamber, and the heating control mechanism may control the electric power supplying mechanism based on the temperature detected by the temperature detector. In this case, the heating control mechanism is capable of maintaining the temperature of the liquid in the pressure chamber in a predetermined temperature range by controlling the electrification mechanism based on the value detected by the temperature detector.

In the liquid transporting apparatus according to the present invention, the pressure chamber may be formed as a plurality of pressure chambers in the channel unit, and the second isolating film may include a plurality of liquid heating portions facing the plurality of pressure chambers respectively, and the plurality of liquid heating portions may be connected in series (may be connected serially). In this case, the plurality of liquid heating portions facing the plurality of pressure chambers respectively being connected in series, an electrical resistance of the plurality of liquid heating portions as a whole becomes substantial, and it is possible to heat rapidly the liquid in the pressure chambers.

In the liquid transporting apparatus according to the present invention, the second isolating film may be arranged substantially on an entire surface of the piezoelectric layer, facing the one surface of the channel unit. In this case, since the second isolating film which is electroconductive is formed on almost the entire surface of the piezoelectric layer facing the channel unit, it is possible to prevent assuredly the liquid in the pressure chamber from permeating into the piezoelectric layer. Furthermore, it is possible to suppress assuredly a leakage of an electric field to the channel unit from the piezoelectric layer, and an entry of a static electricity to the piezoelectric layer from the side of the channel unit.

In the liquid transporting apparatus according to the present invention, the second isolating film may be formed of one of a metallic material, carbon, and an electroconductive ceramics. Since a metallic material, carbon, and an electroconductive ceramics have more dense composition (high barrier property) than composition of a resin material which forms the first isolating film, it is possible to prevent the liquid from permeating into the piezoelectric layer crossing through the first isolating film.

DETAILED DESCRIPTION OF THE PREFERRED EMBODIMENTS

Next, an embodiment of the present invention will be described below. The embodiment described below is an example in which the present invention is applied to an ink-jet head for an ink-jet printer which transports an ink up to nozzles, and makes jet droplets of the ink on to a recording paper from the nozzles.

Figure 1:
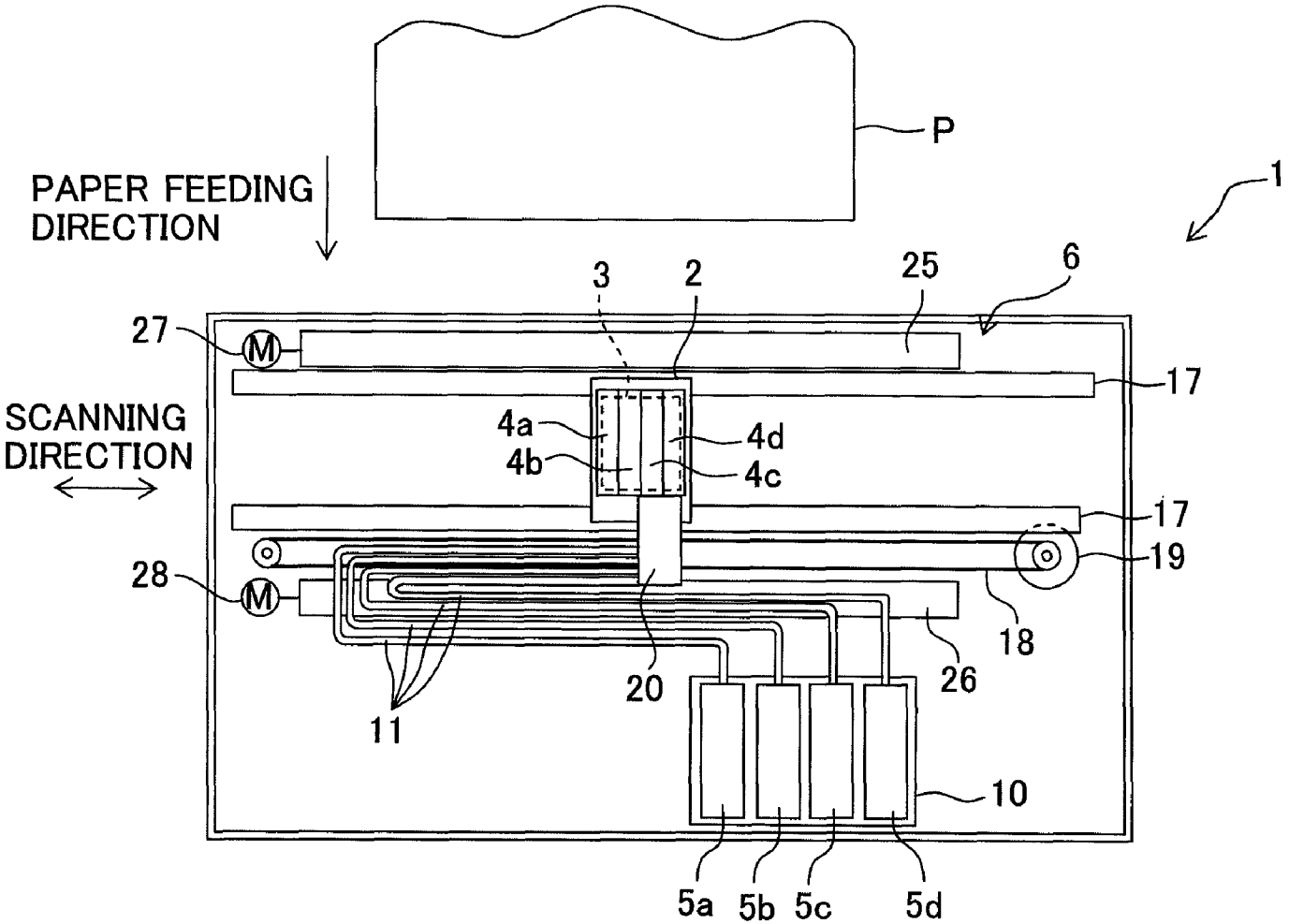
FIG. 1 is a schematic structural view of an ink-jet printer according to an embodiment of the present invention.

Firstly, a schematic structure of an ink-jet printer 1 which includes an ink-jet head (liquid transporting apparatus) of the embodiment will be described. FIG. 1 is a schematic plan view of the ink-jet printer 1 of the embodiment. As shown in FIG. 1, the ink-jet printer 1 includes a carriage 2 which is reciprocatably movable along one direction, an ink-jet head 3 and sub tanks 4*a*, 4*b*, 4*c*, and 4*d* (hereinafter, "sub tanks 4*a* to 4*d*") which are mounted on the carriage 2, ink cartridges 5*a*, 5*b*, 5*c*, and 5*d* (hereinafter, "ink cartridges 5*a* to 5*d*") which store inks to be used in the ink-jet head 3, a transporting mechanism 6 which transports a recording paper P in a paper feeding direction in FIG. 1, and a control unit 7 (refer to FIG. 6) which carries out an overall control of the ink-jet printer 1.

The carriage 2 is reciprocatably movable along two guide shafts 17 extended parallel to a left-right direction (scanning direction). Moreover, an endless belt 18 is connected to the carriage 2, and when the endless belt 18 is driven to be run by a carriage driving motor 19, the carriage 2 moves in the left-right direction with the running of the endless belt 18.

The ink-jet head 3 and the four sub tanks 4*a* to 4*d* are mounted on the carriage 2. The ink-jet head 3 includes a plurality of nozzles 54 (refer to FIG. 2) for jetting liquid droplets, in a lower surface thereof (surface on a rearward side of a paper surface). Moreover, the four sub tanks 4*a* to 4*d* are arranged along a scanning direction, and a tube joint 20 is provided integrally to these four sub tanks 4*a* to 4*d*. The four sub tanks 4*a* to 4*d* and the four ink cartridges 5*a* to 5*d* are connected by flexible tubes 11 respectively which are connected to the tube joint 20.

Inks of four colors namely black, yellow, cyan, and magenta are stored in the four ink cartridges 5*a* to 5*d*, and the ink cartridges 5*a* and 5*d* are detachably mounted on a holder 10.

The inks of four colors stored in the four ink cartridges 5*a* to 5*d* are supplied to the four sub tanks 4*a* to 4*d* via the four tubes 11, and after being temporarily stored in the sub tanks 4*a* and 4*d*, are supplied to the ink-jet head 3. The ink-jet head 3 jets droplets of ink on to the recording paper P which is transported downward in FIG. 1 (paper feeding direction) by the transporting mechanism 6 from the nozzles 54 provided on the lower surface thereof (refer to FIG. 2), while reciprocating in the scanning direction together with the carriage 2.

The transporting mechanism 6 includes a paper feeding roller 25 which is arranged at an upstream side in a paper feeding direction, of the ink-jet head 3, and a paper discharge roller 26 which is arranged at a downstream side in the paper feeding direction, of the ink-jet head 3. The paper feeding roller 25 and the paper discharge roller 26 are driven to be rotated by a paper feeding motor 27 and a paper discharge motor 28 respectively. The transporting mechanism 6, by the paper feeding roller 25, supplies the recording paper P to the ink-jet head 3 from above, and by the paper discharge roller 26, discharges to a lower side in FIG. 1, the recording paper P having an image or characters printed thereon by the ink-jet head 3.

Figure 2:
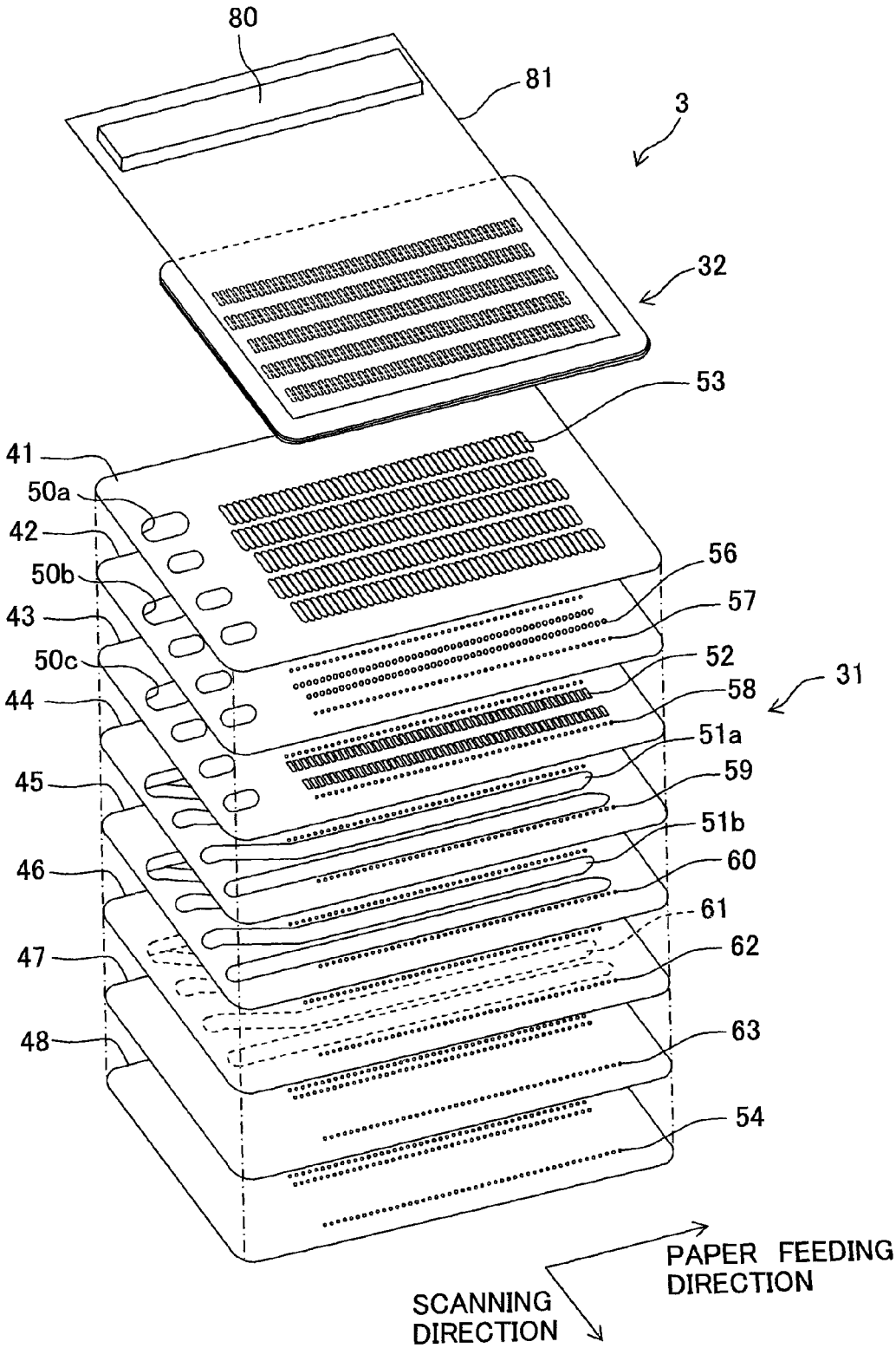
FIG. 2 is an exploded perspective view of the ink-jet head.
Figure 3:
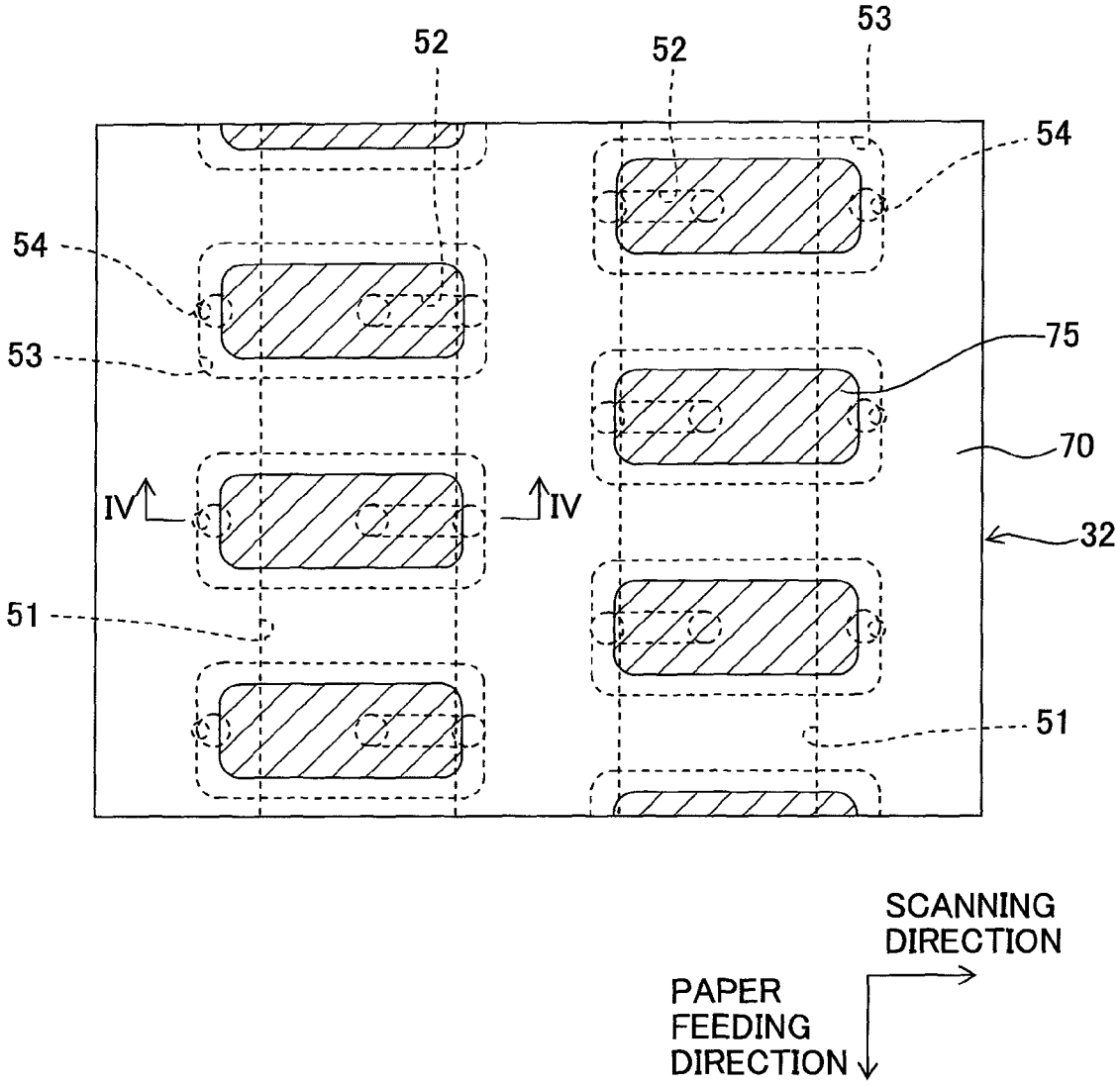
FIG. 3 is a partially enlarged plan view of the ink-jet head.
Figure 4:
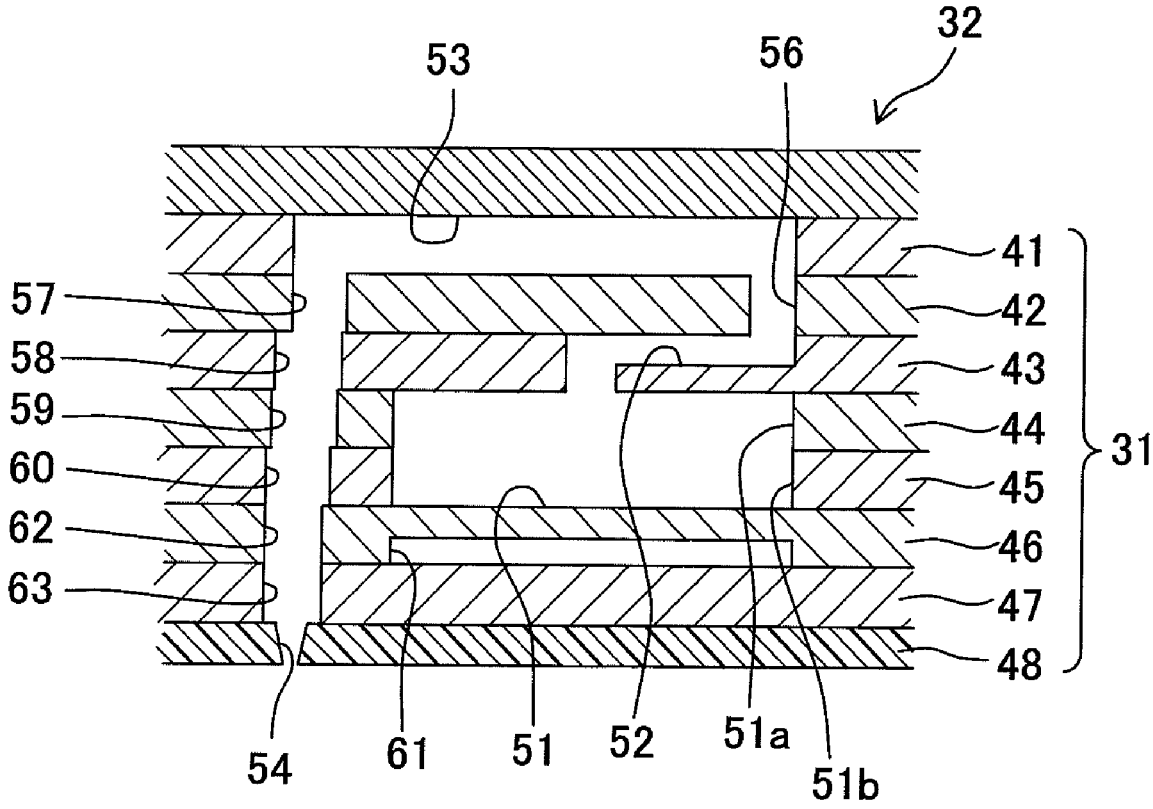
FIG. 4 is a cross-sectional view taken along a line IV-IV in FIG. 3.

Next, the ink-jet head 3 will be described below. FIG. 2 is an exploded perspective view of the ink-jet head 3, FIG. 3 is a partially enlarged plan view of the ink-jet head 3, and FIG. 4 is a cross-sectional view taken along a line IV-IV in FIG. 3. In the following description of the ink-jet head 3, a vertical direction in FIG. 3 (stacking direction of plates) is defined as a vertical direction.

As shown in diagrams from FIG. 2 to FIG. 4, the ink-jet head 3 includes a channel unit 31 in which ink channels including a plurality of nozzles 54 and a plurality of pressure chambers 53 are formed, and a piezoelectric actuator 32 which is arranged on an upper surface of the channel unit 31, and which applies a pressure for making jet an ink inside the pressure chamber 53 from the nozzle 54.

Firstly, the channel unit 31 will be described. The channel unit 31 is made of a stacked-layer body of eight plates namely a cavity plate 41, a base plate 42, an aperture plate 43, two manifold plates 44 and 45, a damper plate 46, a cover plate 47, and a nozzle plate 48 (hereinafter collectively called as "plates 41 to 48"). Out of the eight plates 41 to 48, the nozzle plate 48 which is the lowermost plate, is made of a synthetic resin material such as polyimide, and the remaining plates 41 to 47 are metal plates made of a metal such as stainless steel and nickel alloy steel plate. Moreover, the eight plates 41 to 48 are joined mutually by an adhesive.

Four ink supply holes 50*a* which are connected to the four sub tanks 4*a* to 4*d* described above respectively, and a manifold channel 51 (manifold forming holes 51*a* and 51*b*) which communicates with the four ink supply holes 50*a* are provided in the channel unit 31, and furthermore, a plurality of individual ink channels reaching the nozzle 54 via the pressure chamber 53, and an aperture 52 are provided to be branching from the manifold channel 51.

The plurality of pressure chambers 53 is formed by through the cavity plate 41 which is positioned at the uppermost layer, from among the eight plates 41 to 48. Each pressure chamber 53 has a substantially rectangular shape in a plan view, with a longitudinal direction of a rectangle in the scanning direction, and when the piezoelectric actuator 32 is stacked on an upper side thereof, and the base plate 42 is stacked on a lower side thereof, the pressure chamber 53 is formed. The pressure chambers 53 are arranged in a row in the paper feeding direction, and there are five such rows of the pressure chambers 53. Out of the five rows of the pressure chamber 53, two rows are of the pressure chambers 53 to which, the black ink which is most frequently used is supplied, and the remaining three rows are of the pressure chambers 53 to which the inks of three colors namely yellow, cyan, and magenta color are supplied respectively. Furthermore, at one end portion (an end portion at left side in FIG. 2) in the paper feeding direction of the cavity plate 41, the four ink supply holes 50*a* which supply to the manifold channel 51 the inks of four colors supplied from the sub tanks 4*a* to 4*d* are formed in a row in the scanning direction.

Through holes 56 and 57 which are cut through two end portions respectively in the longitudinal direction of the pressure chamber 53, and an ink supply hole 50*b* which communicates with the ink supply hole 50*a* are formed in the base plate 42.

An aperture 52 as a diaphragm channel, which communicates with the through hole 56 in the base plate 42 and which is extended along the longitudinal direction of the pressure chamber 54, a through hole 58 which communicates with the through hole 57, and an ink supply hole 50*c* which communicates with the ink supply hole 50*b* are formed in the aperture plate 43.

Five manifold forming holes 51*a* and 51*b* each, which are extended in the paper feeding direction and which form a part of the manifold channel 51 are formed in the manifold plates 44 and 45 corresponding to the rows of the pressure chambers 53. Moreover, the manifold channels 51 are formed by the manifold forming holes 51*a* and 51*b* being closed from both the upper side and the lower side by the aperture plate 43 and the damper plate 46, in a state of the two types of manifold forming holes 51*a* and 51*b* overlapping vertically. Out of the five manifold channels 51 provided in the channel unit 31, two manifold channels 51 correspond to the two rows of pressure chambers 53 for the black ink, and the remaining three manifold channels 51 correspond to the three rows of pressure chambers 53 for the color inks. As shown in FIG. 2, the two types of manifold forming holes 51*a* and 51*b* which form the manifold channels 51 are extended up to a position overlapping with the ink supply hole 50*c* in the aperture plate 43, and communicate with the ink supply hole 50*c*. Furthermore, through holes 59 and 60 which communicate with the through hole 58 in the aperture plate 43 are formed in the two manifold plates 44 and 45.

A recess 61 is formed by a half etching in a lower surface of the damper plate 46, at a position overlapping with each of the five manifold channels 51 in a plan view. In other words, a thickness of the damper plate 46 is locally thin at a portion in which the recess 61 is formed, and this thin portion acts as a damper portion which attenuates a pressure fluctuation inside the manifold channel 51. Moreover, a through hole 62 which communicates with the through hole 60 in the manifold plate 45 is also formed in the damper plate 46. A through hole 63 which communicates with the through hole 62 in the damper plate 46 is formed in the cover plate 47.

The nozzles 54 communicating with the through hole 63 in the cover plate 47 are drilled in a row in the paper feeding direction, and are arranged in five rows in the scanning direction. Jetting ports of the plurality of nozzles 54 are arranged on a lower surface of the nozzle plate 48, which becomes a liquid droplet jetting surface jetting liquid droplets from the jetting ports on to the recording paper P facing the plurality of jetting ports. Out of the five nozzle rows, two nozzle rows are for jetting the black ink which is used most frequently, and the remaining three nozzle rows are for jetting the color inks of three colors (cyan, magenta, and yellow).

By the eight plates 41 to 48 described above being joined in a stacked formed, ink channels from the ink supply hole 50 up to the manifold channel 51, and a plurality of individual ink channels branching from the manifold channel 51 and reaching the nozzle 54 via the aperture 52 and the pressure chamber 53 are formed in the channel unit 31.

Figure 5:
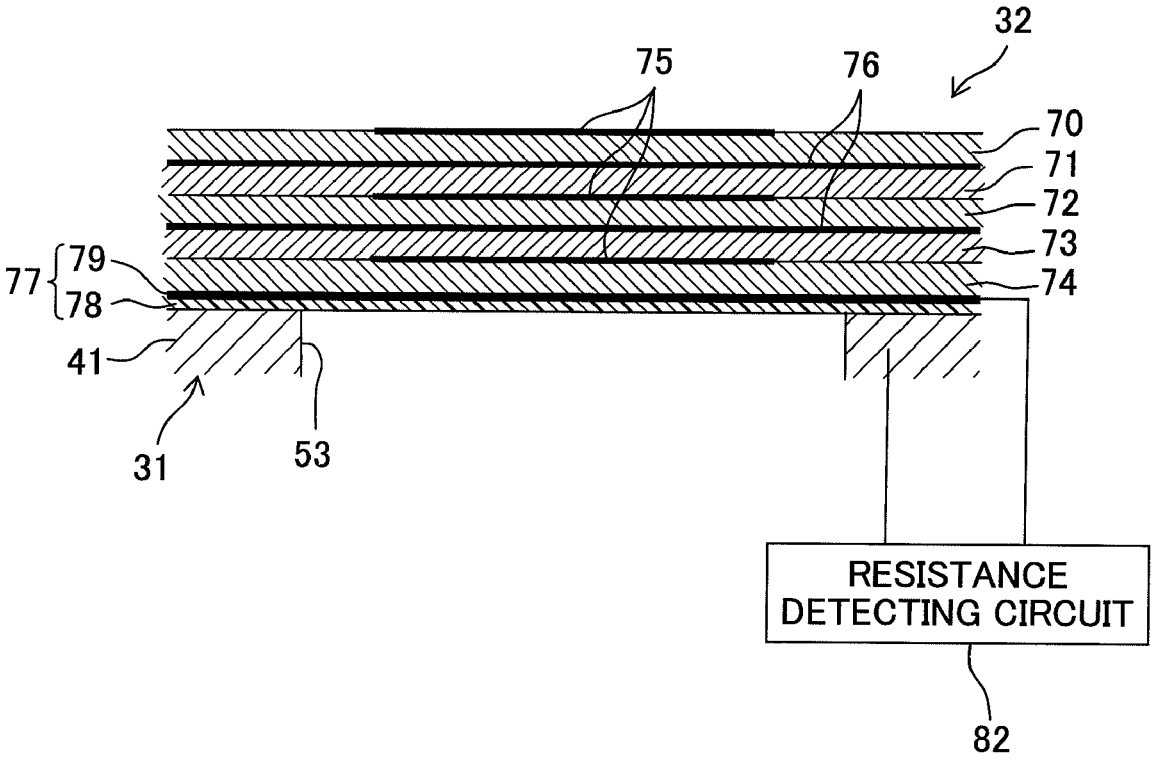
FIG. 5 is an enlarged cross-sectional view of a piezoelectric actuator in FIG. 4.

Next, the piezoelectric actuator 32 will be described below. FIG. 5 is an enlarged view of the piezoelectric actuator 32 in FIG. 4. As shown in FIG. 5, the piezoelectric actuator 32 includes five piezoelectric layers 70, 71, 72, 73, and 74 (hereinafter, "piezoelectric layers 70 to 74") arranged on an upper surface of the channel unit 31, individual electrodes 75 and common electrodes 76 which are provided on both surfaces of the four piezoelectric layers 70, 71, 72, and 73 (hereinafter, "piezoelectric layers 70 to 73") from the top, to sandwich the piezoelectric layers 70 to 73 in a direction of thickness, in an area facing each of the pressure chambers 53, and an isolating film 77 which is provided on a lower surface of the lowermost piezoelectric layer 74. Out of the five piezoelectric layers 70 to 74, the four piezoelectric layers 70 to 73 from the top which become active layers as it will be described later are polarized in a direction of thickness (vertical direction).

The five piezoelectric layers 70 to 74 are formed of a piezoelectric material (a piezoelectric material which is principally composed of lead zirconium titanate (PZT) which is a ferroelectric substance) to be in the form of a sheet having a substantially rectangular shape in a plan view. Moreover, the five piezoelectric layers 70 to 74, in the state of being stacked mutually, are arranged continuously to cover the plurality of pressure chambers 53 on the upper surface of the channel unit 31.

The individual electrodes 75 and the common electrodes 76 are arranged on both surfaces of the four piezoelectric layers 70 to 73 positioned at the upper side out of the five piezoelectric layers 70 to 74. More concretely, the individual electrodes 75 and the common electrode 76 are arranged alternately in a direction in which the piezoelectric layers 70 to 74 are stacked such that, while the individual electrode 75 is arranged on an upper surface of the uppermost piezoelectric layer 70, the individual electrode 76 is arranged between the uppermost piezoelectric layer 70 and the second piezoelectric layer 71 from the top which is under the uppermost piezoelectric layer 70. The individual electrodes 75 and the common electrodes 76 are formed of an electroconductive material such as gold, platinum, palladium, and silver.

Each individual electrode 75 has a substantially rectangular shape in a plan view, slightly smaller than the pressure chamber 53, and is arranged on the upper surface or the lower surface of the piezoelectric layers 70 to 73, in an area facing a substantially central portion of the pressure chamber 53. Moreover, the three individual electrodes 75 at different vertical positions, facing one pressure chamber 53 are in electrical conduction mutually by an electroconductive material filled in through holes (omitted in the diagram) in the piezoelectric layers 70 to 73. Furthermore, as shown in FIG. 2, by the individual electrode 75 arranged on an upper surface of the uppermost piezoelectric layer 70 being connected to a driver IC 80 via a flexible circuit board (FPC) 81, one of a predetermined driving electric potential and a ground electric potential is applied simultaneously from the driver IC 80 to the three individual electrodes 75 corresponding to one pressure chamber 53.

The common electrodes 76 are formed on a surface of the piezoelectric layers 70 to 73 on which the individual electrode 75 is not arranged, on almost entire area including an area facing each of the plurality of pressure chambers 53. Consequently, each common electrode 76 is facing all the individual electrodes 75 positioned at an upper side and a lower side thereof respectively. Moreover, the two common electrodes 76 at different positions in vertical direction are in electrical conduction mutually by an electroconductive material filled in through holes (omitted in the diagram) in the piezoelectric layers 70 to 73. Furthermore, by the common electrode 76 positioned at an upper side being connected to a ground wire of the driver IC 80 via the FPC 81, the two common electrodes 76 are kept at the ground electric potential all the time.

Here, an action of the piezoelectric layer 32 at the time of making liquid droplets jet from the nozzles 54 will be described. When a predetermined driving electric potential is applied from the driver IC 80 to the three individual electrodes 75 corresponding to a certain pressure chamber 53, in an area thereof facing the pressure chamber 53, an electric potential difference is generated between the individual electrode 75 to which the driving electric potential is applied, and the common electrode 76 which is kept at the ground electric potential, and the four piezoelectric layers 70 to 73 on the upper side sandwiched between the individual electrode 75 and the common electrode 76 become active layers to which an electric potential in a direction of thickness is applied. A direction of the electric field is parallel to a direction in which the piezoelectric layers 70 to 73 are polarized, and a portion of each of the four piezoelectric layers 70 to 73 to which the electric potential is applied (portion facing the pressure chamber 53) is elongated in the direction of thickness due to a piezoelectric longitudinal effect. Accordingly, the lowermost piezoelectric layer 74 is deformed to form a projection upon being pushed toward the pressure chamber 53, and a volume of the pressure chamber 53 decreases. Due to the decrease in the volume of the pressure chamber 53, a pressure of the ink inside rises up, and droplets of ink are jetted from the nozzle 54 communicating with the pressure chamber 53.

Furthermore, in the embodiment, the piezoelectric actuator 32 includes an isolating film 77 which is provided almost on entire lower surface of the lowermost piezoelectric layer 74, and interposed between the stacked body of the five piezoelectric layers 70 to 74, and the upper surface of the channel unit 31 on which the plurality of pressure chambers 53 have opened. The isolating film 77 is for isolating the piezoelectric layers 70 to 74 from the ink inside the pressure chamber 53, and preventing the ink from permeating into the piezoelectric layers 70 to 74.

As shown in FIG. 5, the isolating film 77, further has a first isolating film 78 made of a resin material, and a second isolating film 79 which is stacked on the first isolating film 78, and is made of an electroconductive material through which the ink hardly passes, and does not pass as much as through the first isolating film 78 (a superior ink barrier property) Moreover, the second isolating film 79 is arranged on an upper side (side of the piezoelectric layers 70 to 74) of the first isolating film 78. Examples of a resin material which form the first isolating film 78 are polyimide resins and aramid resins. It is possible to form the first isolating film 78 by sticking a resin in the form of a film or by applying a resin material in a liquid form. Moreover, examples of the material which forms the second isolating film 79 are materials having a composition (texture) more dense than a composition (texture) of the resin material, having a superior ink barrier property such as, metallic materials, carbon, or electroconductive ceramics such as silicon carbide. It is possible to form the second isolating layer 79 by a method such as sputtering. For example, it is desirable that a thickness of the first isolating film 78 is about 10 μm and a thickness of the second isolating film 79 is about 1 μm.

In this manner, the first isolating film 78 made of a resin material being in contact with the ink in the pressure chamber 78, and the second isolating film 79 having a superior ink barrier property which is stacked on the first isolating film 78 being positioned toward the piezoelectric layers 70 to 74, even when the ink has passed through the first isolating film 78 having a comparatively inferior ink barrier property, an attempt of the ink to permeate into the piezoelectric layers 70 to 74 is hindered by the second isolating film 79. Consequently, a short (short-circuit) between the individual electrodes 75 or between the individual electrode 75 and the common electrode 76 due to the ink permeated into the piezoelectric layers 70 to 74 is prevented assuredly.

Even when the isolating film 77 is formed only by the second isolating film 79 having a superior ink barrier property, it is possible to inhibit the permeation of the ink through the piezoelectric layers 70 to 74. However, for suppressing a decline in efficiency of deformation of the piezoelectric actuator 32 due to the isolating film 77 being provided, it is preferable that a thickness of the isolating film 77 is as less as possible, and when such second isolating film 79 is exposed, due to various factors such as a change in an internal stress and a contact with impurities from outside during stages of manufacturing and use of a product, there may be problems such as an occurrence of a defect such a damage or a crack, and the ink barrier property is declined.

Since the second isolating film 79 of the isolating film 77 of the embodiment is covered by the first isolating film 78 made of a resin material which is soft, a damage or a crack hardly occurs in the second isolating film 79, and the ink barrier property is prevented from being declined. Moreover, particularly, when the second isolating film 79 is a film made of a metallic material, by the second isolating film 79 being covered by the first isolating film 78, the metallic material which forms the second isolating film 79 is prevented from being eluted into the ink.

Furthermore, in the embodiment, the second isolating film 79 not only has a superior ink barrier property as compared to the ink barrier property of the first isolating film 78 but also is electroconductive. Therefore, when an electric field in a direction of thickness of the piezoelectric layers 70 to 73 is applied between the individual electrode 75 and the common electrode 76 at the time of driving the piezoelectric actuator 32 by the second isolating film 79 which is electroconductive, by isolating the electric field by the second isolating film 79, it is possible to prevent the electric field from being leaked to the ink inside the pressure chamber 53. Moreover, conversely, since it is possible to cut off a static electricity which enters the piezoelectric layers 70 to 74 from a side of the channel unit 31, it is possible to prevent a damage of the piezoelectric layers 70 to 74 due to a local electric field which is generated due to the static electricity.

Particularly, in the embodiment, since the second isolating film 79 which is electroconductive is formed almost on the entire lower surface (surface facing the channel unit 31) of the lowermost piezoelectric layer 74, it is possible to prevent assuredly the ink inside the pressure chamber 53 from permeating into the piezoelectric layers 70 to 74, and to suppress assuredly the leaking of the electric field to the channel unit 31 from the piezoelectric layers 70 to 74, and conversely, the entry of the static electricity to the piezoelectric layers 74 from the side of channel unit 31.

Furthermore, a surface of the channel unit 31 with which, the first isolating film 78 makes a contact is an upper surface of the cavity plate 41 made of a metallic material, and is an electroconductive surface. Therefore, the first isolating film 78 made of a resin material is sandwiched between the second isolating film 79 which is electroconductive and the upper surface of the channel unit 31, which is electroconductive. Therefore, by detecting an electrical resistance between the second isolating film 79 and the upper surface of the channel unit 31, it is possible to know about a state of the first isolating film 78 sandwiched between the second isolating film 79 and the upper surface of the channel unit 31.

In other words, as shown in FIG. 5, the ink-jet head 3 of the embodiment includes a resistance detecting circuit 82 (resistance detector) which detects the electrical resistance between the second isolating film 79 and the channel unit 31 (cavity plate 41). In other words, the ink-jet head 3 includes the second isolating film 79 and the resistor detecting circuit 82 as a deterioration detecting mechanism which detects a deterioration of the first isolating film, and the channel unit 31. Moreover, in a state of no damage caused to the first isolating film 78, since the second isolating film 79 and the channel unit 31 are insulated by the first isolating film 78, the electrical resistance between the second isolating film 79 and the channel unit 31 which is detected by the resistance detecting circuit 82 becomes great. On the other hand, when there is a damage such as a break or a scratch occurred to the first isolating film 78, the electrical resistance between the second isolating film 79 and the channel unit 31 which is detected by the resistance detecting circuit 82 becomes small.

Next, an electrical structure of the ink-jet printer 1 with the control unit 7 as a main component will be described below by referring to a block diagram in FIG. 6. The channel unit 7 shown in FIG. 6 includes a central processing unit (CPU), a read only memory (ROM) in which various computer programs and data which control an overall operation of the ink-jet printer 1 are stored, a random access memory (RAM) which temporarily stores data to be processed by the CPU, and an input-output interface which carries out transmission and reception of signals to and from an external device.

Figure 6:
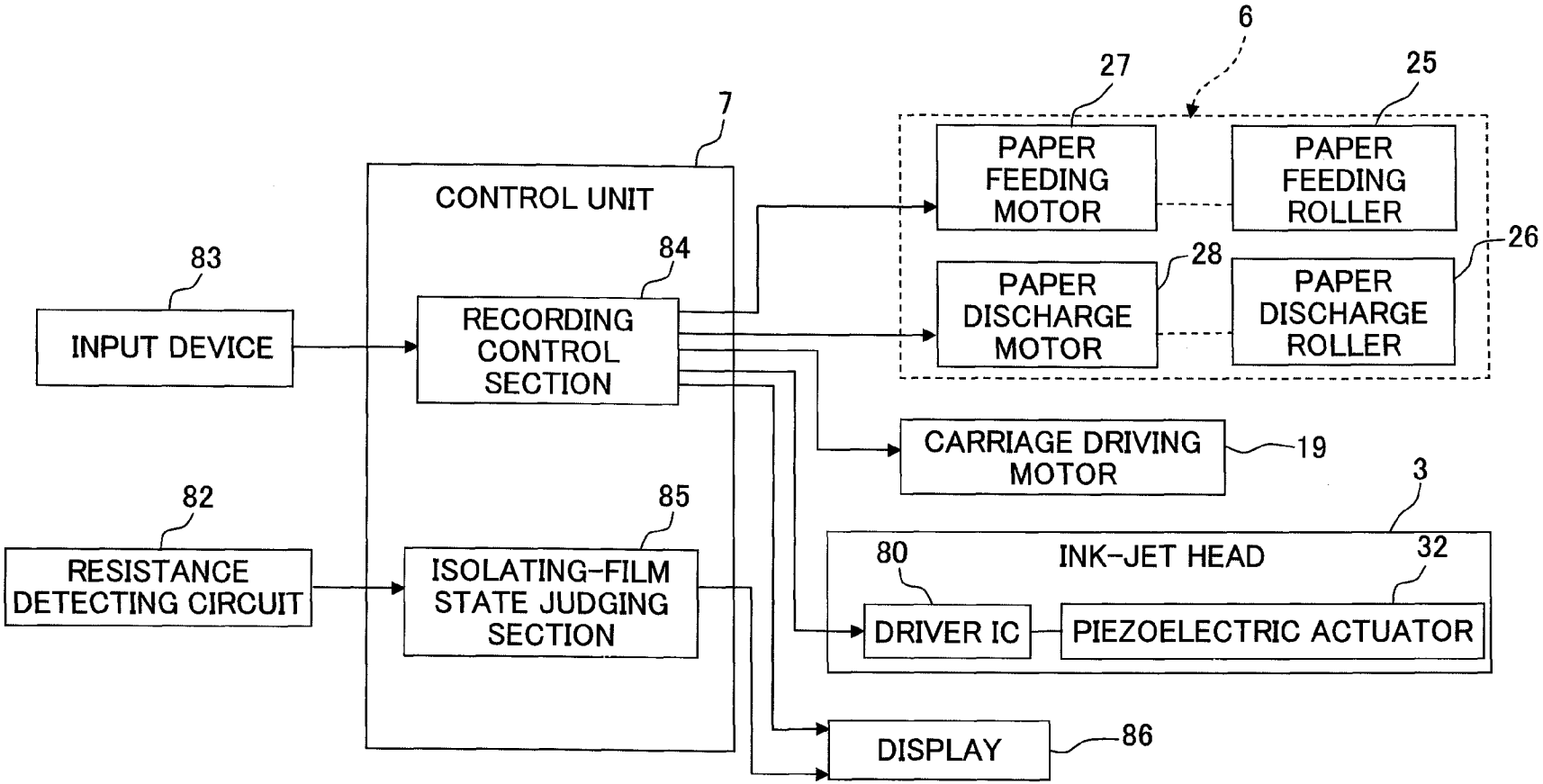
FIG. 6 is a block diagram showing schematically an electrical structure of the ink-jet printer.

Moreover, as shown in FIG. 6, the control unit 7 includes a recording control section 84. The recording control section 84 controls components such as the ink-jet head 3, the carriage driving motor 19 which drives the carriage 2, and the paper feeding motor 27 and a paper discharge motor 28 of the transporting mechanism 6, to record an image on the recording paper P based on data related to an image to be recorded which is inputted from an input device 8. The recording control section 84 displays an error message and information related to recording on a display 86.

Furthermore, the control unit 7 has an isolating-film state judging section 85 which judges a state of the first isolating film 78 based on the electrical resistance between the second isolating film 79 and the channel unit 31 (refer to FIG. 5), which is detected by the resistance detecting circuit 82. Concretely, when a value of the electrical resistance detected by the resistance detecting circuit 82 is not less than a predetermined value, the isolating-film state judging section 85 makes a judgment that the first isolating film 78 made of a resin material is normal without any damage. On the other hand, when the value of the electrical resistance detected by the resistance detecting circuit 82 is less than the predetermined value, the isolating-film state judging section 85 makes a judgment that the first isolating film 78 is in an abnormal state with a decline (decrease) in an insulating property due to some sort of damage occurred thereto. Further, the judgment made by the isolating-film state judging section 85 is notified to a user by displaying on the display 86.

Here, a timing of detecting the electrical resistance by the resistance detecting circuit 82 is not restricted to a particular timing, and may be during a recording operation of the ink-jet printer 1 or may be during a stand-by state in which the recording operation is not being carried out. In other words, at an arbitrary timing, it is possible to measure the electrical resistance between the upper surface of the channel unit 31 and the second isolating film 79 by the resistance detecting circuit 82, and to detect a defect in the first isolating film 78 by the isolating-film state judging section 85 based on a result of the measurement.

Functions of each of the recording control section 84 and the isolating-film state judging section 85 are realized by various control programs stored in the ROM of the control unit 7 being executed by the CPU.

Next, modified embodiments in which, various modifications are made in the embodiment will be described below. However, same reference numerals are assigned to components which have a structure similar as in the embodiment, and the description of such components is omitted.

In the embodiment, the ink-jet printer 1 includes the resistance detector which detects the electrical resistance between the second isolating film 79 and the upper surface of the channel unit 31. However, in a case of detecting as to whether or not there is a damage in the first isolating film 78 during the manufacturing stage, in a case in which a resistance detector is prepared separately from the ink-jet printer 1, and it is possible to measure the electrical resistance by connecting the resistance detector to the ink-jet head 3 (the upper surface of the channel unit 31 and the second isolating film 79), the resistance detecting circuit 82 is not required to be provided particularly, to the ink-jet printer 1.

In the embodiment, the isolating film 77 is formed almost on the entire lower surface of the piezoelectric layer 74. However, since the isolating film 77 is essentially for preventing the ink inside the pressure chamber 53 from permeating into the piezoelectric layers 70 to 74, for this object, the isolating film 77 is not particularly required to be provided almost on the entire lower surface of the piezoelectric layers 70 to 74, and may be provided discretely on an area facing the plurality of pressure chambers 53 respectively.

When the second isolating film 79 has both the superior ink barrier property as compared to the first isolating film 78, and the electroconductivity, it is also possible to use the second isolating film 79 as a heater for heating the ink in the pressure chamber 53.

A viscosity of the ink depends on a temperature of the ink, and lower the ink temperature, higher is the viscosity. Moreover, when the viscosity is high, since a high jetting energy is necessary for making jet the same amount of liquid droplets from the nozzle 54, a drive signal (a waveform or a voltage value) which is to be supplied from the driver IC 80 to the piezoelectric actuator 32, corresponding to an environmental temperature around the head and the temperature of the ink has hitherto been adjusted. However, in this case, since it is necessary to use properly upon preparing a plurality of different drive signals such as waveform and voltage value (in the embodiment, an electric potential difference between the driving electric potential and the ground electric potential), it has been one of causes which make a power supply configuration and a control configuration complicated.

Figure 7:
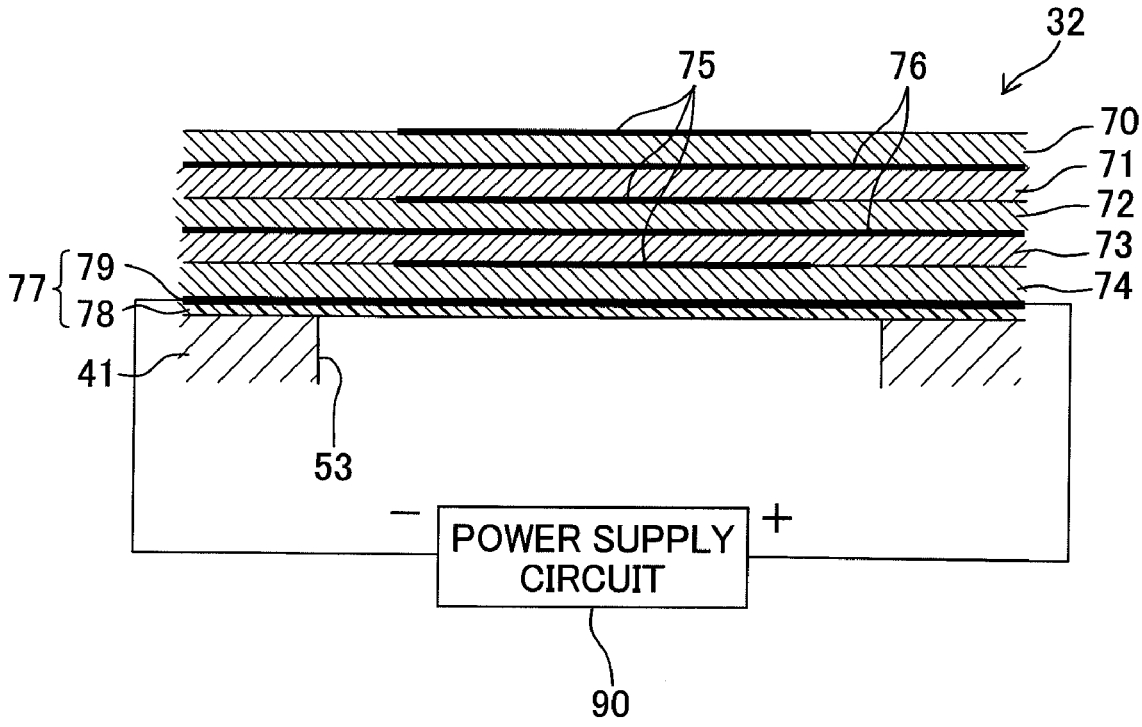
FIG. 7 is an enlarged cross-sectional view corresponding to FIG. 5 according to a modified embodiment of the present invention.
Figure 8:
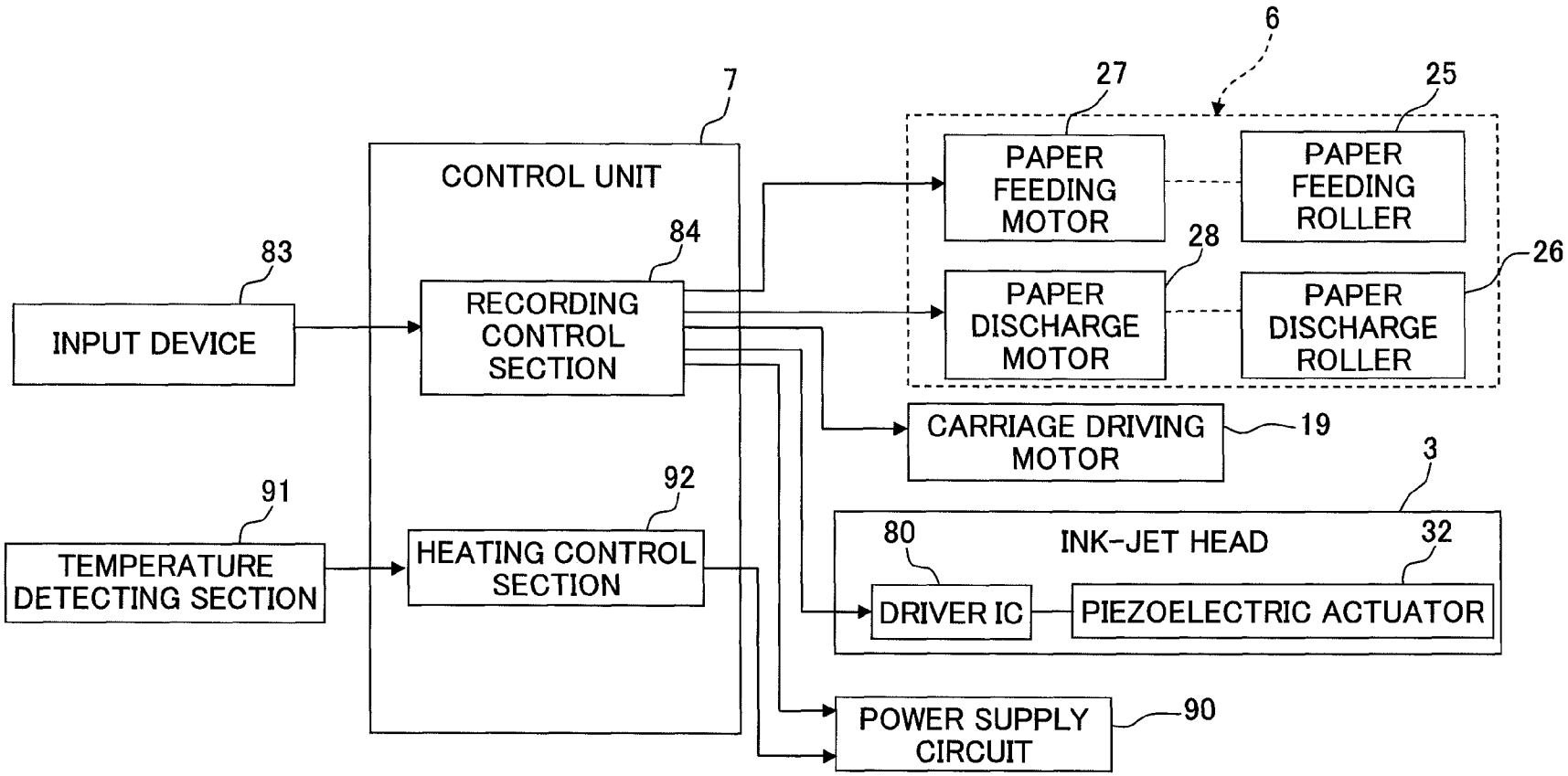
FIG. 8 is a block diagram of an ink-jet printer according to the modified embodiment in FIG. 7.

Therefore, an arrangement may be made such that, the second isolating film 79 which is electroconductive, heats up the ink inside the pressure chamber 53 by the heat released when the electric power is supplied. In other words, as shown in FIG. 7 and FIG. 8, an ink-jet printer of a third modified embodiment includes a power supply circuit 90 (electric power supplying mechanism) which is connected to the second isolating film 79 which is electroconductive, and which supplies an electric power to the second isolating film 79, and a temperature detecting section 91 (temperature detector) which detects the temperature around the pressure chamber 53. Further, the ink-jet printer of the third modified embodiment includes in the control unit 7, a heating control section 92 (heating control mechanism) which controls the supply of electric power to the second isolating film 79 by the power supply circuit 90, based on the value detected by the temperature detecting section 91, and heats the ink inside the pressure chamber 53 by the heat released from the second isolating film 79.

As a material for forming the second isolating film 79, a material which is electroconductive, and further a material, which releases the heat effectively with a small amount of electric power supplied (an electric current and a time for which the electric power is supplied) is preferable. Examples of such electroconductive material, among metallic materials are, a nickel-chromium alloy, an iron-chromium alloy, and a copper-nickel alloy. Moreover, examples of a non-metallic material are silicon carbide, molybdenum silicide, and ruthenium oxide (RuO).

Moreover, it is possible to use various types of temperature detectors as the temperature detecting section 91, and a temperature detector which measures an electrostatic capacitance of a piezoelectric layer portion near the pressure chamber 53 by making use of a phenomenon that the electrostatic capacitance (a dielectric constant) of the piezoelectric layer has a temperature dependency, and detects a temperature fluctuation from the electrostatic capacitance may be used. Or, an arrangement may be made to detect a temperature of the piezoelectric layer etc. around the pressure chamber 53 by a temperature detecting section 91 of a thermocouple type. Further, a temperature detector may be a detector which directly measures the temperature of the ink inside the pressure chamber 53.

When an electric power is supplied to the second isolating film 79 by the power supply circuit 90, the second isolating film 79 releases heat. The heat released by the second isolating film 79 is transmitted to the ink inside the pressure chamber 53 via the first isolating film 78, and the ink is heated. The second isolating film 79 to which the electric power is supplied by the power supply circuit 90 being covered by the first isolating film 78 made of a resin material having an electrical insulating property, the second isolating film 79 and the ink inside the pressure chamber 53 are not in direct contact, and there is no shorting (short-circuit) between the second isolating film 79 and the ink when the electric power is supplied.

According to such an arrangement, even when a surrounding temperature (environmental temperature) of the ink-jet head 3 is low, since it is possible to decrease the viscosity of the ink by heating the ink in the pressure chamber 53 by making the second isolating film 79 release heat by supplying the electric power to the second isolating film 79 by the power supply circuit 90, it is possible to secure predetermined jetting characteristics (an amount of liquid droplets jetted and a jetting speed) even without adjusting the waveform and the voltage value of a drive signal. Moreover, even for a highly viscous ink, which is difficult to handle due to high viscosity at the surrounding environmental temperature, by increasing sufficiently the ink temperature with respect to the environmental temperature, it is possible to lower the viscosity of the ink to a level at which the ink is jettable from the nozzle 54 even without making the voltage value of the drive signal high. Furthermore, when the ink inside the pressure chamber 53 is being heated, the piezoelectric layers 70 to 74 in the area facing the pressure chamber 53 are also heated simultaneously. However, when a temperature of the piezoelectric layer rises up, normally, a deformation efficiency of the piezoelectric layer improves. Therefore, it is possible to increase an amount of displacement of the piezoelectric layers 70 to 74 without increasing the voltage of the drive signal.

Moreover, as the heating control section 92 controls the supply of the electric power from the power supply circuit 90 based on the value detected by the temperature detecting section 91, it is possible to maintain the temperature of the ink inside the pressure chamber 53 in a predetermined range appropriate for jetting the ink droplets.

When not that highly accurate temperature control of the ink inside the pressure chamber 53 is sought, as it has been described above, it is not necessary to carry out the control based on the temperature substantially near the pressure chamber 53, and a simpler control may be carried out. For instance, when an arrangement is made to measure only the temperature of surrounding (environmental temperature) of the ink-jet head 3, and when the environmental temperature is lower than a predetermined temperature, a control may be carried out such that the electric power is supplied continuously for a predetermined time which is determined in advance.

Figure 9:
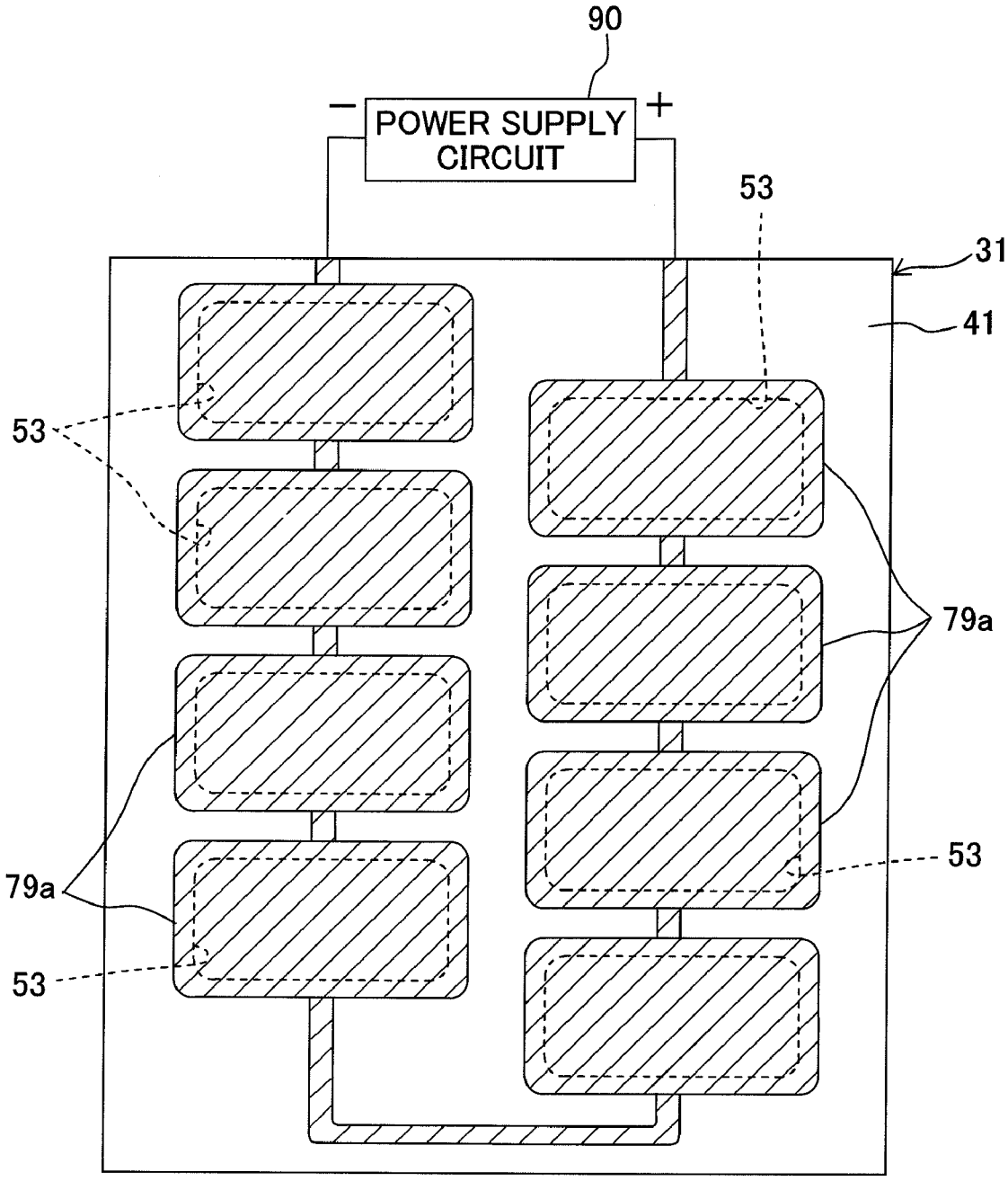
FIG. 9 is a diagram in which, an ink-jet head according to another modified embodiment is viewed from a top surface of a channel unit in which an isolating film is arranged.

Moreover, as it has been described earlier, since the isolating film 77 is essentially for preventing the ink inside the pressure chamber 53 from permeating into the piezoelectric layers 70 to 74, the isolating film 77 is not particularly required to be provided almost on the entire lower surface of the piezoelectric layer 74, and may be provided only in an area facing the plurality of pressure chambers 53. FIG. 9 is a diagram in which, an ink-jet head according to the third modified embodiment is viewed from a top surface of a channel unit (cavity plate) in which an isolating film is arranged.

In this case, the second isolating film 79 which is electroconductive, is divided into a plurality of ink heating portions 79*a* (liquid heating portions) arranged on the upper surface of the cavity plate to face the plurality of pressure chambers 53 respectively. Here, each of the ink heating portions 79*a* may be connected individually (parallel connection) to the power supply circuit 90, and an arrangement may be such that, with the plurality of ink heating portions 79*a* connected in series, the ink heating portion 79*a* at a tail end is connected to the power supply circuit 90 as shown in FIG. 9. In this case, since an overall electrical resistance of the plurality of ink heating portions 79*a* becomes substantial, an amount of heat released when the same electric current is passed becomes substantial as compared to an arrangement in parallel connection. In other words, it is possible to heat rapidly the ink inside the pressure chamber 53 with a small electric current.

When the second isolating film 79 is electroconductive, it is also possible to use the second isolating film 79 as an electrode for making act an electric field in the piezoelectric layer. For instance, in FIG. 5 of the embodiment, at least at the time of using the ink-jet head 3 (at the time of jetting liquid droplets), by keeping the second isolating film 79 at the ground electric potential, it is possible to use the second isolating film 79 as the common electrode 76 which generates an electric field in the piezoelectric layer between the individual electrodes 75 which are switched to the driving electric potential.

As it has been described above, the description has been made by citing examples in which, the present invention is applied to the ink-jet head which makes jet (droplets of ink) from the nozzles by applying a pressure to the ink inside the ink channels. However, the application of the present invention is not restricted only to such ink-jet heads. In other words, the present invention is also applicable to liquid transporting apparatuses used in various fields, which transport liquid other than inks such as drug solutions and biochemical solutions up to a predetermined position with an object other than jetting the liquid droplets outside, by applying a pressure to such liquids.

In the embodiment described above and the modified embodiments thereof, the explanation has been made about the example in which the present invention is applied to the ink-jet head 3 which is attached to the lower surface of the carriage 2 and which discharges the ink from the nozzles 54 formed on the lower surface while reciprocating in the scanning direction together with the carriage 2. However, the present invention is not limited thereto. The present invention is also applicable to a line type head in which a plurality of nozzles are aligned in series in the scanning direction.

What is claimed is:

1. A liquid transporting apparatus which transports a liquid, comprising:

a channel unit having a surface which is electroconductive and a liquid channel which includes a pressure chamber and through which the liquid flows, the pressure chamber being open to the surface;

a piezoelectric actuator applying a pressure to the liquid in the pressure chamber and having a piezoelectric layer arranged to face the surface of the channel unit and to cover the pressure chamber, electrodes which are arranged in the piezoelectric layer to face the pressure chamber, and a first isolating film formed of a resin material and arranged between the piezoelectric layer and the surface of the channel unit to face the pressure chamber; and a deterioration detecting mechanism detecting a deterioration of the first isolating film and having a second isolating film which is electroconductive and stacked on a surface, of the first isolating film, on a side of the piezoelectric layer, and which is insulated from both the electrodes and the channel unit.

2. The liquid transporting apparatus according to claim 1, wherein the second isolating film is formed of a material through which the liquid does not pass as easily as through the first isolating film.

3. The liquid transporting apparatus according to claim 1, wherein the surface of the channel unit and the second isolating film are arranged to sandwich the first isolating film therebetween; and the deterioration detecting mechanism includes a resistance detector which detects an electrical resistance between the surface of the channel unit and the second isolating film.

4. The liquid transporting apparatus according to claim 3, further comprising judging section which judges that the first isolating film is deteriorated when the electrical resistance detected by the resistance detector is less than a predetermined electrical resistance.

5. The liquid transporting apparatus according to claim 1, further comprising:

an electric power supplying mechanism which supplies electric power to the second isolating film; and a heating control mechanism which controls the electric power supplying mechanism to supply the electric power to the second isolating film, such that the liquid in the pressure chamber is heated by heat released from the second isolating film.

6. The liquid transporting apparatus according to claim 5, further comprising:

a temperature detector which detects a temperature around the pressure chamber, wherein the heating control mechanism controls the electric power supplying mechanism based on the temperature detected by the temperature detector.

7. The liquid transporting apparatus according to claim 6, wherein the heating control mechanism controls the electric power supplying mechanism to supply the electric power to the second isolating film when the temperature detected by the temperature detector is less than a predetermined temperature.

8. The liquid transporting apparatus according to claim 5, wherein the pressure chamber is formed as a plurality of pressure chambers in the channel unit; and the second isolating film includes a plurality of liquid heating portions facing the plurality of pressure chambers respectively, and the liquid heating portions are connected in series.

9. The liquid transporting apparatus according to claim 1, wherein the second isolating film is arranged substantially on an entire surface, of the piezoelectric layer, facing the surface of the channel unit.

10. The liquid transporting apparatus according to claim 1, wherein the second isolating film is formed of a metallic material.

11. The liquid transporting apparatus according to claim 1, wherein the second isolating film is formed of carbon.

12. The liquid transporting apparatus according to claim 1, wherein the second isolating film is formed of an electroconductive ceramics.

* * * * *